US005706724A

United States Patent [19]

Siler

[11] Patent Number: 5,706,724

[45] Date of Patent: Jan. 13, 1998

[54] HIGH-VOLTAGE CONTACT ASSEMBLY FOR A GRAVURE PRESS

[75] Inventor: Steven J. Siler, Fox River Grove, Ill.

[73] Assignee: Hurletron, Incorporated, Danville, Ill.

[21] Appl. No.: 616,057

[22] Filed: Mar. 14, 1996

[51] Int. Cl.[6] ..... B41F 9/00

[52] U.S. Cl. ..... 101/153; 101/489; 101/170

[58] Field of Search ..... 101/152, 153, 101/216, 154, 489, 219, 170; 439/20, 21, 18, 23, 24, 25, 13

[56] References Cited

U.S. PATENT DOCUMENTS

| | | | |
|---|---|---|---|
| Re. 22,869 | 4/1947 | Huebner . | |
| 699,784 | 5/1902 | Brooks . | |
| 2,408,143 | 9/1946 | Huebner | 101/18 |
| 2,742,582 | 4/1956 | Bahn et al. | 310/52 |
| 2,776,385 | 1/1957 | Modrey | 310/71 |
| 2,854,647 | 9/1958 | Nugent | 339/5 |
| 3,022,479 | 2/1962 | Rohrbach | 339/8 |
| 3,234,495 | 2/1966 | Martinez | 339/5 |
| 3,245,341 | 4/1966 | Childress et al. | 101/122 |
| 3,370,546 | 2/1968 | Muller | 101/91 |
| 3,477,369 | 11/1969 | Adamson et al. | 101/153 |
| 3,661,081 | 5/1972 | Wright | 101/426 |
| 4,099,462 | 7/1978 | Coberley et al. | 101/153 |
| 4,329,004 | 5/1982 | Lewis | 339/5 M |
| 4,539,908 | 9/1985 | Spengler | 101/426 |
| 4,664,538 | 5/1987 | Galbato | 384/477 |
| 4,697,514 | 10/1987 | George et al. | 101/170 |
| 4,909,147 | 3/1990 | George et al. | 101/170 |
| 4,966,555 | 10/1990 | Zagorski | 439/28 |
| 5,243,487 | 9/1993 | Klett | 361/56 |
| 5,399,248 | 3/1995 | Ettelbruck et al. | 204/212 |
| 5,401,540 | 3/1995 | Miles et al. | 427/428 |

OTHER PUBLICATIONS

Hurletron Incorporated Drawing No. 328370 dated Jun. 20, 1969.

Hurletron Incorporated Drawing No. 329280 dated Dec. 4, 1970.

*Primary Examiner*—J. Reed Fisher

*Attorney, Agent, or Firm*—Marshall, O'Toole, Gerstein, Murray & Borun

[57] ABSTRACT

A gravure printing press assembly composed of an impression roller having a core portion, a support shaft for the core portion which is rotatable with respect to the core portion, and an outer conductive layer disposed about the core portion and a high-voltage contact assembly for applying a high voltage to the impression roller. The high-voltage contact assembly comprises a first assembly having a brush support member and a plurality of brushes associated with the brush support member, the brushes being held by the brush support member at a plurality of positions circumferentially disposed with respect to a central axis passing through the support shaft; a second assembly having a conductive contact ring disposed adjacent the brushes and being rotatable relative to the first assembly; and means for allowing relative movement between the first assembly and the second assembly in a direction parallel to the central axis of the support shaft.

27 Claims, 3 Drawing Sheets

HIGH-VOLTAGE CONTACT ASSEMBLY FOR A GRAVURE PRESS

BACKGROUND OF THE INVENTION

The present invention is directed to a high-voltage contact assembly for a gravure printing press and a method of installing the contact assembly on the press.

Gravure printing presses may employ a contact assembly for applying a high voltage to the central core portion of the impression roller of the press. For example, U.S. Pat. No. 4,966,555 to Zagorski discloses a rotary contact for a gravure printing press that is composed of a rotating ring member and a stationary ring member which are permanently coupled together via a pair of annular ball bearing assemblies. A high voltage is supplied to a plurality of carbon brushes disposed on the stationary ring member. By making contact with the rotating ring member, the brushes transfer the high voltage to the rotating ring member and the core portion of the impression roller to which the rotating ring member is attached.

A significant problem of a rotary contact assembly as disclosed in the Zagorski patent is that the annular ball bearing assemblies may wear with use of the rotary contact assembly, thus necessitating relatively frequent maintenance of the bearing assemblies or causing failure of the rotary contact assembly.

SUMMARY OF THE INVENTION

The invention is directed to a high-voltage contact assembly adapted to be coupled to an impression roller of a gravure printing press. The contact assembly includes a first assembly having a brush support member and a plurality of brushes associated with the brush support member, the brushes being held by the brush support member at a plurality of positions circumferentially disposed with respect to a central axis passing through the support shaft of the impression roller.

The contact assembly includes a second assembly having a conductive contact member disposed adjacent the brushes and being rotatable relative to the first assembly and means for allowing relative movement between the first assembly and the second assembly in a direction parallel to the central axis of the support shaft.

The means for allowing relative movement between the first assembly and the second assembly may comprise bearing means, such as an O-ring, fixed to one of the first and second assemblies and movable relative to the other of the first and second assemblies in a direction parallel to the central axis of the support shaft. The contact assembly may also comprise means for adjustably aligning the first assembly relative to the second assembly in a direction parallel to the central axis of the support shaft, such as a locking member for fixing the second assembly to the support shaft, and vapor barrier means in the form of a pair of annular sealing members.

The invention is also directed to a method of installing a high-voltage contact assembly on an impression roller of a gravure printing press assembly, the impression roller having a core portion, a support shaft for supporting the core portion and being rotatable with respect to the core portion, and an outer conductive layer disposed about the core portion, the high-voltage contact assembly having a first assembly with a brush support member and a plurality of brushes and a second assembly with a conductive contact member and being rotatable relative to the first assembly.

The method includes the steps of (a) connecting one of the first and second assemblies to the core portion of the impression roller so that the one assembly is fixed relative to the core portion of the impression roller; (b) moving the other of the first and second assemblies along the support shaft of the impression roller in a direction parallel to a longitudinal central axis of the support shaft until the other assembly reaches a desired position along the central axis of the support shaft; and (c) with the other assembly in the desired position, fixing the other assembly to the support shaft of the impression roller so that the other assembly is maintained in the desired position.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
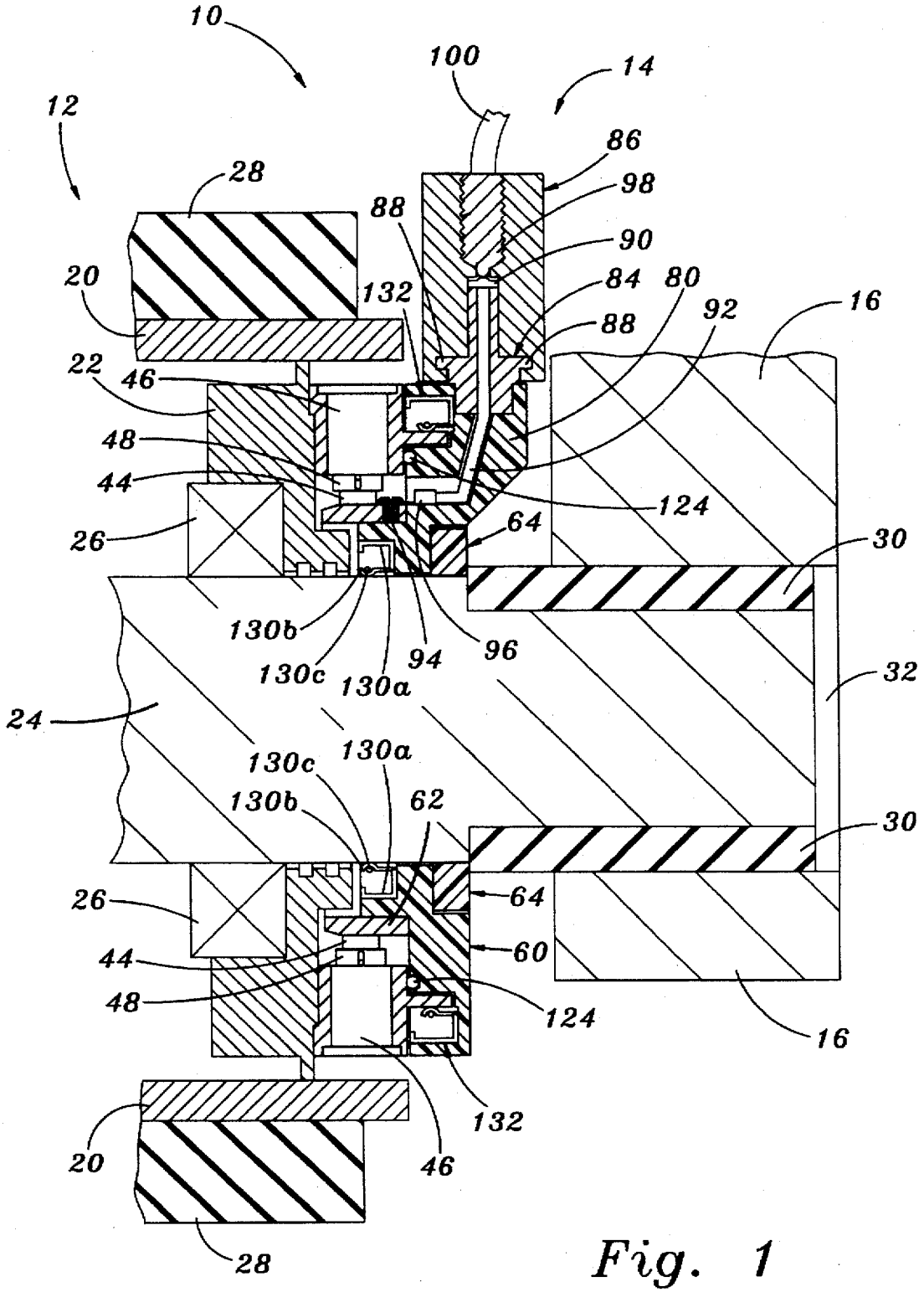
FIG. 1 is a cross-sectional top view of a preferred embodiment of a gravure press assembly with a contact assembly in accordance with the invention.

FIG. 1 is a top cross-sectional view of a preferred embodiment of a gravure printing press assembly 10 in accordance with the invention. Referring to FIG. 1, the press assembly 10 includes an impression roller 12, a contact assembly 14 for applying a high voltage to the impression roller 12, and a stationary support frame 16. The impression roller 12 has a central core portion composed of a hollow metal cylinder 20 and an annular metal end plate 22 fixed within an end of the cylinder 20, a central support shaft 24, and a set of bearings, schematically shown at 26, for rotatably supporting the core portion of the impression roller 12 on the central support shaft 24. An outer semi-conductive rubber sleeve 28 is mounted over the metal cylinder 20.

The right-hand end of the support shaft 24 has an insulating sleeve 30 mounted thereon and is disposed within a bore 32 formed in the support frame 16. During operation of the press, the support shaft 24, the insulating sleeve 30, and the support frame 16 remain stationary, while the metal cylinder 20, the end plate 22 and the outer sleeve 28 rotate together via the bearings 26.

Figure 2:
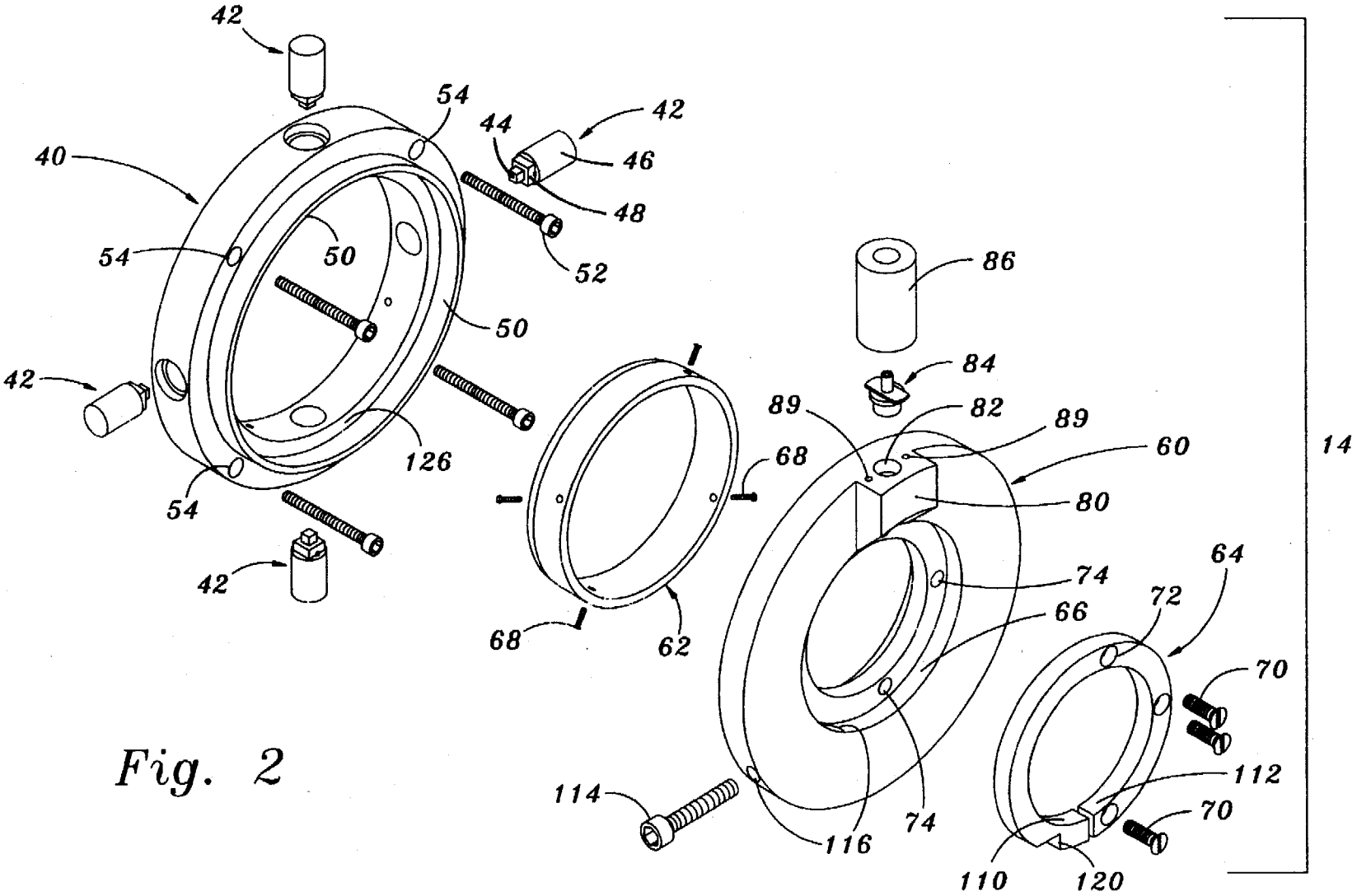
FIG. 2 is an exploded perspective view of the contact assembly of FIG. 1.

Referring to FIG. 2, the contact assembly 14 is composed of a first assembly portion in the form of an annular brush support member 40 and four brush assemblies 42 mounted about the circumference of the brush support member 40. Each of the brush assemblies 42 has a brush 44 composed of a solid body of conductive carbon, a cylindrical mounting body 46, and a spring mechanism 48 for spring-biasing the brush 44 outwards relative to the mounting body 46. The mounting bodies 46 may be secured in place in the brush support member 44 by any conventional means, such as by gluing. As used herein, the term "brush" includes any type of conductive contact member and is not limited to conductive contact members having bristles. Each brush assembly 42 may be provided in the form of a brush and holder which are commercially available from Phoenix Electric.

Figure 3:
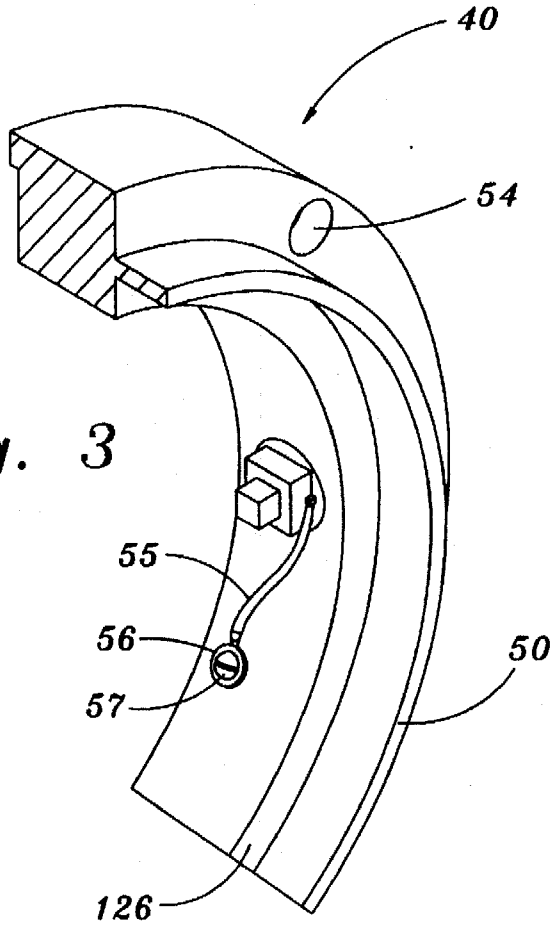
FIG. 3 is a perspective view of a portion of the contact assembly.

The brush support member 40, which has an annular extension 50, is mounted to the end plate 22 via four screws 52, each of which passes through a respective bore 54 formed in the brush support member 40 and into a respective threaded bore (not shown) in the end plate 22. Referring to FIG. 3, each brush 44 is conductively connected to the brush support member 40 via a wire 55, a conductive eye-connector 56, and a screw 57 threaded into the support plate 40, which is conductively coupled to the conductive rubber sleeve 28 via contact with the metal cylinder 20 and the end plate 22 of the impression roller 12.

Referring to FIG. 2, the contact assembly 14 includes a second assembly portion composed of a generally annular insulating cover 60, a conductive brush contact ring 62 fixed to one side of the cover 60, and a locking clamp 64 disposed within an annular groove 66 in the cover 60 for anchoring the second assembly to the support shaft 24 at a desired position along its longitudinal axis. The brush contact ring 62 is connected to the cover 60 via a plurality of screws 68, and the locking clamp 64 is connected to the cover via a plurality of screws 70 which pass through a plurality of bores 72 in one side of the locking clamp 64 into a plurality of threaded bores 74 in the cover 60. The cover 60, the locking clamp 64, and the screws 70 may be composed of any one of various insulating materials, such as nylon.

A mounting flange 80 having a circular bore 82 formed therein is integrally formed at the top of the cover 60. The bottom cylindrical end of an adapter 84 is disposed within the bore 82 in the mounting flange 80, and a high-voltage connector 86 is removably attached to the adapter 84. The adapter 84 has a pair of asymmetric wings 88 (FIG. 1) which retain the high-voltage connector 86 in place when the connector 86 has a first rotational orientation and which release the connector 86 (by passing through an asymmetric opening in the bottom of the connector 86) when the connector 86 is rotated to a second rotational orientation. Rotation of the high-voltage connector 86 may be facilitated by a pair of ball detent inserts 89 disposed in the top surface of the mounting flange 80.

Referring to FIG. 1, the adapter 84 has an upper contact member 90 which is conductively coupled to a high-voltage wire 92 connected to the contact ring 62 via a single screw 94 and metal eye-connector 96. The high-voltage connector 86 has a conductive contact member 98 attached to a high-voltage cable 100 which is connected to a power supply (not shown) which supplies a high voltage, such as 2,500 volts. When the high-voltage connector 86 is attached to the adapter 84, a high voltage is supplied to the contact ring 62 from the high-voltage supply via the conductive connections described above.

Figure 4:
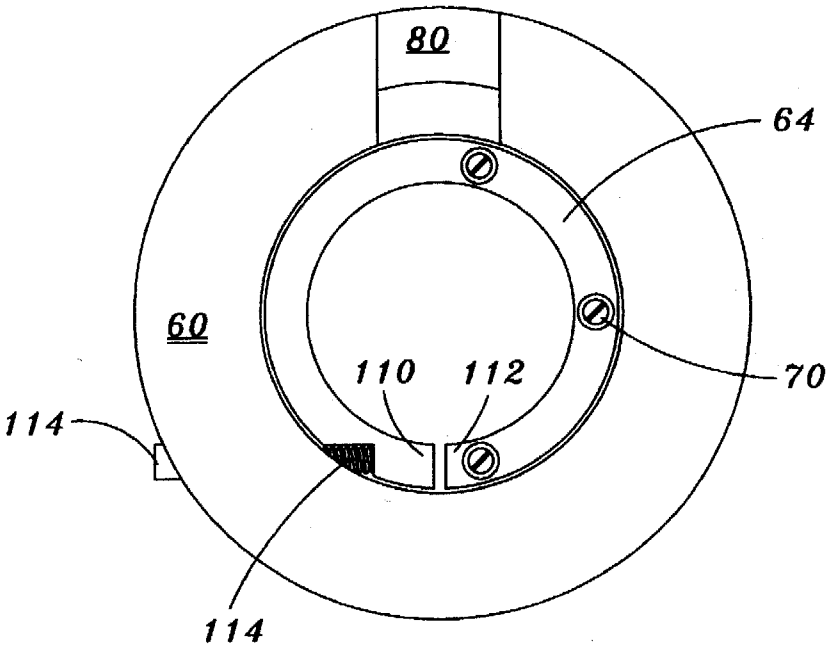
FIG. 4 is a side view of a portion of the gravure press assembly of FIG. 1.

Referring to FIGS. 2 and 4, the locking clamp 64 has a pair of bottom ends 110, 112 which can be forced together to reduce the internal diameter of the clamp 64 to secure the clamp 64, and the cover 60 to which it is fixed, at a fixed location on the central longitudinal axis of the support shaft 24. The bottom ends 110, 112 of the locking clamp 46 are forced together (by forcing the end 110 towards the end 112, the position of which is fixed) by a locking screw 114 which passes through a partially threaded bore 116 in the cover 60. When screwed into the bore 116, the end of the locking screw 114 makes contact with a contact face 120 on the bottom end 110 of the locking clamp 64, forcing the ends 110, 112 together.

Referring to FIG. 1, an O-ring 124 is disposed within an annular channel formed in the cover 60 and makes contact with a side face 126 (see FIG. 2) of the brush support member 40. A first annular seal 130 is disposed about the circumference of the support shaft 24 within an annular channel formed within the cover 60. The seal 130 is composed of an annular metal support frame **130*a*, a rubber sealing member 130*b*, and a helically wound spring 130*c* for urging the rubber sealing member 130*b* inwardly against the support shaft 24. A similar seal 132 disposed within an annular channel within the cover 60 makes sealing contact with the exterior face of the annular extension 50 (FIG. 2) of the brush support member 40. The seals 130, 132 act as vapor barriers to isolate the high-voltage spatial area in the vicinity of the brushes 44 from the ambient spatial area, which is typically saturated with potentially explosive ink vapors, in which the gravure press assembly 10 is disposed. The seals 130, 132** may be shaft seals commercially available from Chicago Rawhide or commercially available face seals.

Referring to FIG. 1, to install the contact assembly 14 onto the impression roller 12, the brush support member 40 (with the brush assemblies 42 disposed therein) is placed over the end of the support shaft 24 (which is removed from the support frame 16 and with the sleeve 30 removed from the support shaft 24) and fastened to the end plate 22 via the screws 52 (FIG. 2). The second portion of the contact assembly 14 (the assembly having the cover 60, the contact ring 62, and the locking clamp 64) is then slid over the end of the support shaft 24 until the O-ring 124 makes contact with the side face 126 (see FIG. 2) of the brush support member 40. With the second portion of the contact assembly 14 in that position, the locking screw 114 is then tightened to fasten the locking clamp 64 to that longitudinal position on the support shaft 24 to prevent the second portion of the contact assembly 14 from moving along the support shaft 24.

After the insulating sleeve 30 is installed on the support shaft 24 and the support shaft 24 is inserted into the support frame 16, the gravure press assembly 10 may be operated by rotating the impression roller 12. During such rotation, the voltage from the high-voltage supply (not shown) is applied to the brush contact ring 62 (via the connections described above), and the physical contact between the contact ring 62 and the brushes 44, which rotate with the impression roller 12 and the brush support member 40, causes the high voltage to be applied to the outer conductive sleeve 28 of the impression roller 12 via the metal cylinder 20 and the metal end plate 22.

Although the preferred embodiment of the invention is described above in connection with an impression roller having a non-rotating central support shaft, the invention could also be used in connection with an impression roller in which the outer cylindrical portion of the roller is fixed to the central shaft and in which the outer cylindrical portion and the shaft rotate together. In this case, the central shaft of the impression roller would be rotatably supported by the printing press frame; the first portion of the contact assembly could be connected to the rotating impression roller; and the second portion of the contact assembly could be connected to the stationary frame. The second portion of the contact assembly could be provided with a shaft bearing to maintain the second portion of the contact assembly in a fixed position relative to the rotating impression roller support shaft.

Additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A gravure printing press assembly, comprising:

an impression roller having a core portion, a support shaft for supporting said core portion, said support shaft being rotatable with respect to said core portion, and an outer conductive layer disposed about said core portion; and a high-voltage contact assembly for applying a high voltage to said impression roller, said contact assembly comprising:

a first assembly having a brush support member and a plurality of brushes associated with said brush support member, said brushes being held by said brush support member at a plurality of positions circumferentially disposed with respect to a central axis passing through said support shaft;

a second assembly having a conductive contact ring disposed adjacent said brushes and being rotatable relative to said first assembly; and means for allowing relative movement between said first assembly and said second assembly in a direction parallel to said central axis of said support shaft.

2. An assembly as defined in claim 1 wherein said means for allowing relative movement between said first assembly and said second assembly comprises bearing means fixed to one of said first and second assemblies and movable relative to the other of said first and second assemblies in a direction parallel to said central axis of said support shaft.

3. An assembly as defined in claim 2 wherein said bearing means comprises an O-ring disposed in an annular channel formed in said second assembly.

4. An assembly as defined in claim 1 additionally comprising means for adjustably aligning said first assembly relative to said second assembly in a direction parallel to said central axis of said support shaft.

5. An assembly as defined in claim 4 wherein said means for adjustably aligning said first assembly relative to said second assembly comprises means for anchoring one of said first and second assemblies to said support shaft.

6. An assembly as defined in claim 5 wherein said anchoring means comprises a locking member for fixing said second assembly to said support shaft.

7. An assembly as defined in claim 1 wherein said impression roller is disposed in an ambient spatial area and wherein said brushes make contact with said conductive contact ring in a high-voltage spatial area, said assembly additionally comprising means for providing a vapor barrier between said high-voltage spatial area and said ambient spatial area.

8. An assembly as defined in claim 1 wherein said brush support member comprises an annular ring.

9. An assembly as defined in claim 1 wherein said brush support member is connected to an end face of said core portion of said impression roller.

10. An assembly as defined in claim 1 wherein said impression roller additionally comprises a bearing for making said support shaft rotatable relative to said core portion.

11. An assembly as defined in claim 1 additionally comprising a stationary support frame, said support shaft of said impression roller being fixed to and non-rotatable with respect to said stationary support frame.

12. An assembly as defined in claim 7 wherein said means for providing a vapor barrier between said high-voltage spatial area and said ambient spatial area comprises a pair of annular sealing members.

13. An assembly as defined in claim 1 wherein each of said brushes comprises:

a body of solid conductive material; and means for spring-biasing said body of solid conductive material against said conductive contact ring.

14. A high-voltage contact assembly adapted to be coupled to an impression roller of a gravure printing press having a central axis which passes through a support shaft of said impression roller, said contact assembly comprising:

a first assembly having a brush support member and a plurality of brushes associated with said brush support member, said brushes being held by said brush support member at a plurality of positions circumferentially disposed with respect to said central axis;

a second assembly having a conductive contact member disposed adjacent said brushes and being rotatable relative to said first assembly; and means for allowing relative movement between said first assembly and said second assembly in a direction parallel to said central axis of said support shaft.

15. An assembly as defined in claim 14 wherein said means for allowing relative movement between said first assembly and said second assembly comprises bearing means fixed to one of said first and second assemblies and movable relative to the other of said first and second assemblies in a direction parallel to said central axis of said support shaft.

16. An assembly as defined in claim 15 wherein said bearing means comprises an O-ring disposed in an annular channel formed in said second assembly.

17. An assembly as defined in claim 14 additionally comprising means for adjustably aligning said first assembly relative to said second assembly in a direction parallel to said central axis of said support shaft.

18. An assembly as defined in claim 17 wherein said means for adjustably aligning said first assembly relative to said second assembly comprises means for anchoring one of said first and second assemblies to said support shaft.

19. An assembly as defined in claim 18 wherein said anchoring means comprises a locking member for fixing said second assembly to said support shaft.

20. An assembly as defined in claim 14 additionally comprising vapor barrier means in the form of a pair of annular sealing members.

21. An assembly as defined in claim 14 wherein each of said brushes comprises:

a body of solid conductive material; and means for spring-biasing said body of solid conductive material against said conductive contact member.

22. A method of installing a high-voltage contact assembly on an impression roller of a gravure printing press assembly, said impression roller having a core portion, a support shaft for supporting said core portion and being rotatable with respect to said core portion, and an outer conductive layer disposed about said core portion, said high-voltage contact assembly having a first assembly with a brush support member and a plurality of brushes and a second assembly with a conductive contact member and being rotatable relative to said first assembly, said method comprising the steps of:

(a) connecting one of said first and second assemblies to said core portion of said impression roller so that said one assembly is fixed relative to said core portion of said impression roller;

(b) moving the other of said first and second assemblies along said support shaft of said impression roller in a direction parallel to a longitudinal central axis of said support shaft until said other assembly reaches a desired position along said central axis of said support shaft; and (c) with said other assembly in said desired position, fixing said other assembly to said support shaft of said impression roller so that said other assembly is maintained in said desired position.

23. A method as defined in claim 22 wherein said step (a) comprises the step of connecting said one assembly to said core portion of said impression roller.

24. A method as defined in claim 22 wherein said step (a) comprises the step of connecting said first assembly to said core portion of said impression roller.

25. A method as defined in claim 22 wherein said step (b) comprises the step of sliding said second assembly along said support shaft until said desired position is reached.

26. A method as defined in claim 22 wherein said step (b) comprises the step of sliding said other assembly along said support shaft until said other assembly makes contact with a bearing disposed on one of said first and second assemblies.

27. A method as defined in claim 22 wherein said step (c) comprises the step of fixing said other assembly to said support shaft by tightening an annular locking member fixed to said other assembly.

* * * * *